US006471896B1

(12) United States Patent
Katsuki et al.

(10) Patent No.: US 6,471,896 B1
(45) Date of Patent: Oct. 29, 2002

(54) METHOD FOR PROCESSING CLOTH

(75) Inventors: Toshiharu Katsuki, Fukui (JP); Youichi Iwasa, Fukui (JP); Harukazu Kubota, Fukui (JP)

(73) Assignee: Seiren Co., Ltd., Fukui (JP)

( * ) Notice: Subject to any disclaimer, the term of this patent is extended or adjusted under 35 U.S.C. 154(b) by 0 days.

(21) Appl. No.: 09/537,988

(22) Filed: Mar. 29, 2000

(30) Foreign Application Priority Data

Apr. 2, 1999 (JP) ..... 11-097102

(51) Int. Cl.[7] ..... D06M 11/38; D06M 13/152; D06P 3/00; D06Q 1/02

(52) U.S. Cl. ..... 264/78; 8/115.56; 8/497; 264/132; 264/342 R

(58) Field of Search ..... 264/78, 132 R, 264/342 R; 8/115.56, 497

(56) References Cited

FOREIGN PATENT DOCUMENTS

JP 60030788 B2 7/1985

JP 02035075 B2 8/1990

*Primary Examiner*—Leo B. Tentoni
(74) *Attorney, Agent, or Firm*—Flynn, Thiel, Boutell & Tanis, P.C.

(57) ABSTRACT

To provide a method for processing a cloth to form a three-dimensional design pattern on the cloth not only by a conventional printing system, but also by an ink-jet system. A method for processing a cloth to form a three-dimensional design pattern on the cloth, which involves two processes—one in which it is treated with a Solution A containing a salt formed from a phenol derivative and a hydroxide of an alkali metal or alkali-earth metal and the other in which it is treated with Solution B containing a chemical capable of restoring the salt in solution A to its original phenol derivative. The present invention is advantageous in using highly safe water-soluble chemicals, allowing their uniform application to a cloth to form a three-dimensional design pattern on the cloth. In addition, the present invention has the advantage of allowing the cloth to be subjected simultaneous to fiber shrinking and coloring, making it very conducive to the production of printed goods with highly accurate and uniform three-dimensional design patterns at reduced costs.

10 Claims, 1 Drawing Sheet

METHOD FOR PROCESSING CLOTH

BACKGROUND OF THE INVENTION

1. Field of the Invention

The present invention relates to a method for processing cloth to form a three-dimensional design pattern on the cloth.

2. Related Art

At present, cloth of high functionality has been developed, finding wide application in the fields of automotive upholstery and building material.

Among such cloth of high functionality is one with three-dimensional design patterns formed on its surface to make it appear solid and refined, which has attracted attention from various industrial fields, especially for use as automotive seat and wall covering material.

Certain techniques are already known for processing cloth to form three-dimensional design patterns on it, which are generally classified into two groups depending on whether they are based on physical or chemical means.

Such prior techniques based on physical means that are applied to a commonly printed cloth include methods wherein the cloth is passed between engraved rolls heated to a high temperature under pressure to form three-dimensional design patterns on the cloth (such as embossing and schreiner calendering). These methods, however, have the disadvantages of involving passage of cloth between heated rolls under a high pressure, which causes the cloth to become hardened and flattened to a significant extent, as well as to assume a metallic luster caused by the heated rolls with a possible change in its color due to the roll heat.

Such prior techniques based on chemical means include a method wherein cloth is printed with a color paste containing chemicals acting to shrink the fiber of the cloth or reduce its weight, thereby forming three-dimensional design patterns on it, as disclosed in JP-B-47-23709.

This method, however, has the disadvantage of requiring naphthol derivatives, hardly soluble in water, to be directly applied to a cloth, resulting in uneven application of the color paste to the cloth, which causes the method to involve a problem with the reproducibility of the resultant three-dimensional design patterns on the cloth.

In the meantime, an ink-jet system has attracted attention as a method for applying inks containing fiber-shrinking agents to a cloth to form a three-dimensional design pattern on the cloth.

This ink-jet system-based method is advantageous in that it allows inks in small amounts to be injected onto a cloth by varying the amounts of the inks and their positions to a subtle extent, thereby providing the cloth with fine three-dimensional design patterns.

Among such methods using an ink-jet system to form a three-dimensional design pattern on cloth is one in which inks containing fiber-shrinking agents are injected from nozzles onto a pile fabric to shrink the piles, thereby forming three-dimensional design patterns on the fabric.

This method, however, has the disadvantage of involving the use of inks with a high viscosity of 100 to 200 cps to prevent ink penetration through the cloth that may otherwise occur, thereby not allowing use of a widespread conventional ink-jet printer for inks of low-viscosity type (1 to 10 cps), but requiring new arrangements with an ink-jet printer optionally designed for high-viscosity inks.

In addition, this method is disadvantageous in that the use of such high-viscosity inks, combined with fiber-shrinking agents that are, as a general rule, hardly soluble in water and thus difficult to disperse in the inks, causes the ink-jet printer to be subject to nozzle clogging and other similar trouble.

A further disadvantage of this method, due to its necessity for the use of such high-viscosity inks, is failure of the fiber-shrinking agents contained in the inks to penetrate deep inside a cloth, resulting in poor development of the resultant three-dimensional design patterns on the cloth.

SUMMARY OF THE INVENTION

It is therefore an object of the present invention to provide a method for processing cloth to form excellent three-dimensional design patterns on the cloth not only by a conventional printing system, but also by an ink-jet system, while solving the problems of the conventional methods mentioned above, as well as to provide a cloth processed by such a method.

As a result of our efforts to solve the problems of the conventional methods mentioned above, we discovered a two-step process of applying a phenol derivative as a fiber-shrinking agent, hardly soluble in water, to a cloth, which consists of a first step of treating the cloth with a solution of the phenol derivative reacted with a hydroxide of an alkali metal or alkali-earth metal for conversion into its corresponding water-soluble salt to achieve uniform application of the fiber-shrinking agent to the cloth, and a second step of treating the cloth with a solution containing a chemical capable of converting the salt into its original phenol derivative to restore the fiber-shrinking agent applied in its water-soluble form to the cloth to its original function. This discovery led us to accomplish the present invention.

Specifically, the present invention consists in (1) a method for processing cloth to form a three-dimensional design pattern on the cloth, comprising two processes—process (a) wherein it is treated with solution A containing a salt formed from a derivative of phenol and a hydroxide of an alkali or alkali-earth metal, and process (b) wherein it is treated with solution B containing a chemical capable of restoring the salt in solution A to its original phenol derivative;

(2) a method as specified in (1) above, in which the chemical capable of restoring the salt in solution A to its original phenol derivative is selected from among three types of compounds—a salt formed from an inorganic acid and a weak base, carboxylic acid and a salt formed from carboxylic acid and a weak base;

(3) a method as specified in (1) above, in which cloth is subjected to said process (a) and process (b) in that order before process (c) of applying dyes to the cloth for its printing;

(4) a method as specified in (1) above, in which cloth is subjected to said process (b) and process (a) in that order before process (c) of applying dyes to the cloth for its printing;

(5) a method as specified in any of (1) to (4) above, in which said process (a) and process (b) are based on an ink-jet system;

(6) a method as specified in (3) or (4) above, in which said process (c) is based on an ink-jet system;

(7) a method as specified in (6) above, in which cloth is treated with said solution A or B contained in an ink acceptor solution for its ink-jet printing; and (8) a cloth processed by such a method as specified in any of (1) to (7) above to form three-dimensional design patterns on it.

PREFERRED EMBODIMENT OF THE INVENTION

Figure 1:
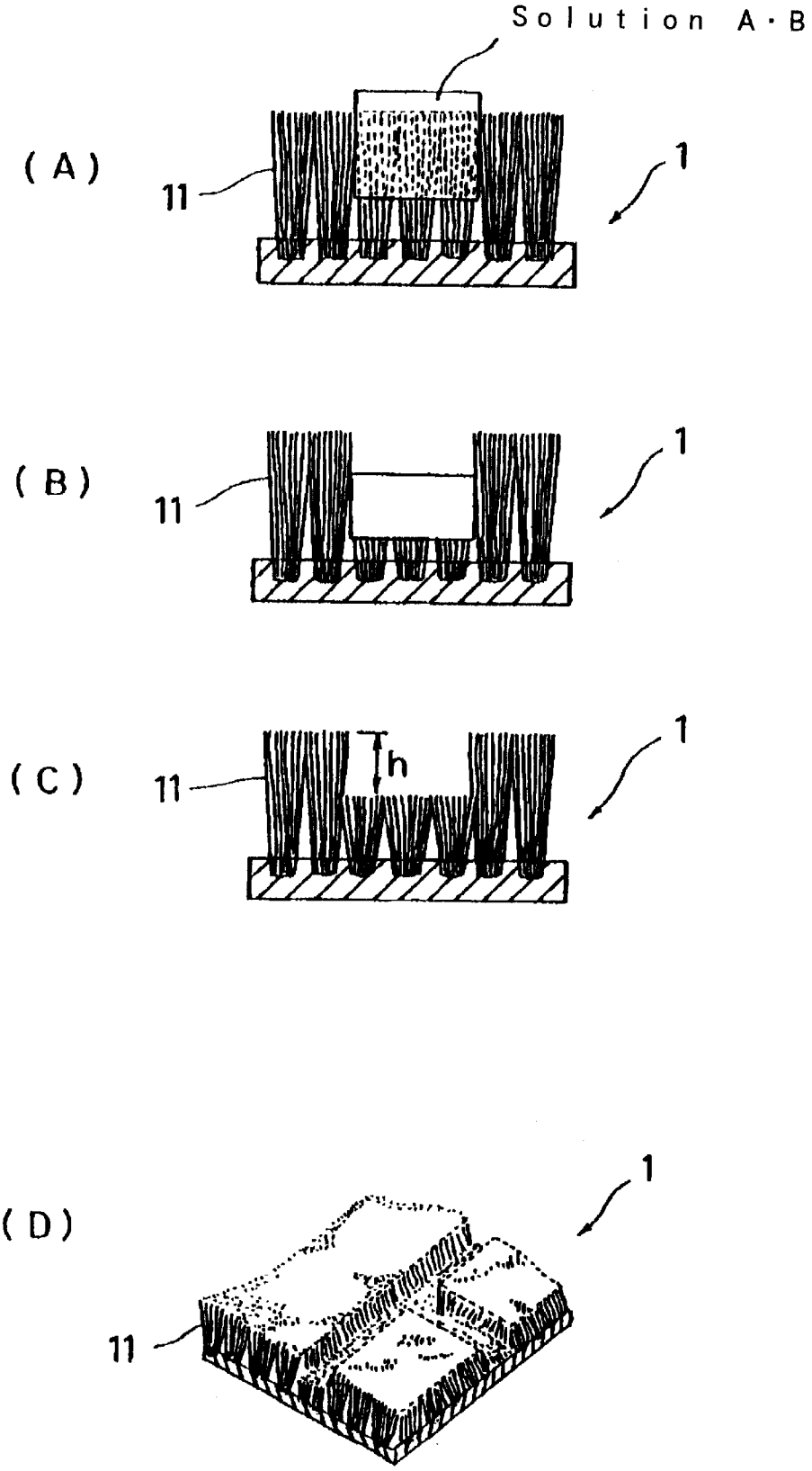
FIGS. 1(A)–1(D) diagrammatically illustrates an embodiment of the present invention's basic principle of forming a three-dimensional design pattern on cloth.

The following describes embodiments of the present invention.

The method of the present invention for processing cloth to form a three-dimensional design pattern on the cloth is achieved by treating it with two types of solutions—Solution A containing a salt formed from a derivative of phenol and a hydroxide of alkali metal or alkali-earth metal and Solution B containing a chemical capable of restoring the salt in Solution A to the original phenol derivative.

Specifically, the application of Solutions A and B, which are specified below in more detail, to cloth in a proper manner, as herein presented, allows the method of the present invention to be accomplished with formation of a three-dimensional design pattern on the cloth as a result of the fiber-shrinking function of the phenol derivative applied to it, which develops when it is thereafter subjected to heat treatment.

The method of the present invention will become apparent from FIGS. 1(A)–1(D), which uses a pile fabric as an example to diagrammatically illustrate an embodiment of its basic principle of forming a three-dimensional design pattern on the fabric.

Referring to FIG. 1(A), pile fabric 1 is treated with Solutions A and B(A), causing the phenol derivative contained in the solution as a fiber-shrinking agent to act on piles 11 for their shrinkage FIG. 1(B) with a resultant surface level difference (h) between the affected pile area and the rest FIG. 1(C) to form three-dimensional design patterns on the fabric FIG. 1(D).

Solution A

Solution A as used in the method of the present invention is a solution containing a salt formed from a derivative of phenol and a hydroxide of alkali metal or alkali-earth metal.

Phenol derivatives are already known to act as a chemical agent to shrink fiber (hereinafter also referred to as a "fiber-shrinking agent"), allowing its effective application to a cloth to form a three-dimensional design pattern on it. Such derivatives are, as a general rule, hardly soluble in water, requiring their dispersion in water or dissolution in an organic solvent for their application to a cloth for the above-mentioned purposes.

However, dispersion of such a practically water-insoluble derivative in water should naturally limit the amount of the derivative that can be technically dispersed in the water, while the use of an organic solvent for its application in a sufficient amount causes an environmental problem.

The above two contradictor problems—a limited dispersibility of a phenol derivative in water and a required use of an organic solvent for its dissolution resulting in pollution—has led us to the basic concept of the present invention, wherein it is neutralized with a chemical such as a hydroxide of an alkali or alkali-earth metal (hereinafter referred to as a "neutralizer") to transform it into its corresponding salt that can be dissolved in water to allow it to be applied to a cloth uniformly at a high concentration.

Phenol derivatives that are useful as fiber-shrinking agents in Solution A of the present invention are compounds composed of an aromatic ring such as benzene or naphthalene whole molecules contain one or more hydroxyl groups (—OH) bound directly to a carbon atom or carbon atoms in the aromatic ring with or without one or more of other functional groups including, not limited to, amino, nitro, carboxyl, hydroxyl, alkoxy and aldehyde, halogen groups, and hydrocarbon groups having or not having such functional and halogen groups.

Such phenol derivatives include phenol, aminophenol, nitrophenol, cresol, ethylphenol, butylphenol, octylphenol, xylenol, dibutylphenol, butylmethylphenol, phenylphenol, methoquinone, vanilline, vanillyl alcohol, hydroxyphenylacetic acid, methyl hydroxyphenylacetate, hydroxyphenylpropionic acid, hydroxyphenylethyl alcohol, hydroxybenzaldehyde, hydroxyacetophenone, hydroxybenzophenone, catechol, resorcinol, hydroquinone, butylcatechol, phenylhydroquinone, dihydroxyphenylacetic acid, dihydroxybenzaldehyde, dihydroxyacetophenone, dihydroxybenzophenone, naphthol, naphthalenediol, nitronaphthol, phloroglucinol, pyrogallol, hydroxybenzoic acid, methyl(ethyl, propyl, butyl or phenyl) hydroxybenzoate, methyl dihydroxybenzoate, methylgallate, propylgallate, hydroxynaphthoic acid, and phenyl hydroxynaphthoate.

Useful neutralizers of the above-mentioned fiber-shrinking agents that are necessary to prepare Solution A of the present invention include sodium hydroxide, potassium hydroxide, lithium hydroxide, magnesium hydroxide, calcium hydroxide and other hydroxides of alkali metals and alkali-earth metals.

Among them, sodium hydroxide is particularly preferable for use as a neutralizer of the present invention because it is commonly available and low-priced.

Solution B

Solution B as used in the method of the present invention serves to convert the salt in Solution A as mentioned above into the original phenol derivative that can function as a fiber-shrinking agent.

Accordingly, Solution B of the present invention is a solution containing a chemical capable of restoring the salt in Solution A to the original phenol derivative (hereinafter referred to as a "restorer"). Specifically, such a restorer is an acid or salt, a solution of which shows a weak acidity.

A properly selected useful restorer of this invention, when applied to a Solution A applied cloth, can form on the cloth a salt that has the property of absorbing moisture (a deliquescent salt), preventing a color paste or ink applied to it from penetrating through it.

The restorers that are useful in the present invention as salts formed from inorganic acids and weak bases include ammonium sulfate, hydrazine sulfate, ammonium nitrate, hydrazine nitrate, ammonium chloride, ammonium dihydrogenphosphate and diammonium hydrogenphosphate.

The restorers that are useful in the present invention as carboxylic acids include formic acid, acetic acid, oxalic acid, lactic acid, malic acid, tartaric acid, citric acid, succinic acid, phthalic acid, maleic acid, benzoic acid, salicylic acid and polycarboxylic acid.

The restorers that are useful in the present invention as salts formed from carboxylic acids and weak bases include ammonium formate, ammonium acetate, ammonium oxalate, ammonium lactate, ammonium tartrate, ammonium malate, ammonium citrate, ammonium succinate, ammonium carbonate, ammonium benzoate and ammonium salicylate.

Sodium dihydrogenphosphate, sodium hydrogensulfate, sodium metaphosphate, sodium trimetaphosphate, sodium hexametaphosphate and other similar compounds can also serve as useful restorers of the present invention.

Among the above, ammonium sulfate is particularly preferable for use as a restorer of the present invention because it is low-priced and safe, and it can react with the salt of Solution A, forming a salt which has the property of absorbing moisture (a deliquescent salt) to serve such a function as mentioned above.

Solutions A and B of the present invention can be used with one or more of anti-volatilizers, catalysts, oil absorbents, antiseptics, antifoaming agents, holding agents, plasticizers, oils/fats, waxes, viscosity controllers, thermosetting resins, cross-linking agents, IR absorbers, UV absorbers, light fastness improvers, anti-oxidants, extender pigments, fluorescent whiteners, adsorbents, anti-reductants, metal ion blocking agents, fillers, pH controllers, moisture absorbents, penetrants, electrolytes, perfumes, antibacterial agents, deodorants, insecticides and other chemicals added to either or both of the solutions in proper amounts as required.

Notwithstanding the above, however, it should be noted that one of the features of the present invention consists in preparing both Solutions A and B using salts or, in the case of the latter, weak acids, whose solution is at a neutral point (pH=7) or in its vicinity, showing excellent solubility in water and having no adverse effects on dyes (including pigments) to enable cloth to be processed, achieving formation of fine three-dimensional design patterns and development of brilliant color on the cloth at the same time.

In the present invention, Solutions A and B can be applied to a cloth using methods based on systems publicly known for cloth printing.

For instance, the application of the solutions to a cloth can be made using one or more of screen, roller, ink-jet and other conventional printing systems.

Among them, an ink-jet printing system is preferable for use in the present invention because it can inject the solutions of the present invention onto cloth in such a fine and precise manner that it can form sharp three-dimensional design patterns on it.

The present invention does not restrict the order in which Solutions A and B are applied to a cloth to form a three-dimensional design pattern on it.

To achieve the objective of this invention, for instance, cloth can be first treated with Solution A wholly or partly as designed and then with Solution B partly as designed or wholly, while, conversely, it can be first treated with Solution B wholly or partly as designed and then with Solution A partly as designed or wholly.

The present invention allows the application of dyes (including pigments) to cloth to form a higher value added three-dimensional design pattern on it.

Specifically, in the present invention, dyes can be applied to a cloth together with either Solution A or B by containing the dyes in the solution (as described in 1 to 4 below) or independently of the application of Solution A or B to the cloth (as described in 5 and 6 below), thereby forming three-dimensional design patterns on it with its color printing.

For example, the application of dyes to a cloth in the present invention can be achieved by the following methods:

1. Application of Solution A containing dyes to a cloth, followed by application of Solution B to the cloth,
2. Application of Solution A to a cloth, followed by application of Solution B containing dyes to the cloth,
3. Application of Solution B containing dyes to a cloth, followed by application of Solution A to the cloth,
4. Application of Solution B to a cloth, followed by application of Solution A containing dyes to the cloth,
5. Application of Solution A to a cloth, followed by application of Solution B to the cloth with subsequent application of dyes to it, and
6. Application of Solution B to a cloth, followed by application of Solution A to the cloth with subsequent application of dyes to it.

As mentioned above, the present invention allows the use of an ink-jet system not only for application of Solutions A and B to cloth, but also for application of dyes to cloth as in the case of 5 or 6 above.

The use of an ink-jet system for such application in the present invention is advantageous in that it allows fine control of the amounts of Solutions A/B and dyes to be injected onto cloth, thereby finely controlling the impression of the resultant three-dimensional design patterns on the cloth and its coloring.

Another advantage of the present invention, when embodied using an ink-jet system for application of dyes to a cloth, is to eliminate the need for applying an ink acceptor to the cloth to prevent bleeding of the dyes applied onto it or improve their penetration into it, because the reaction between Solutions A and B applied to it before or during its ink-jet printing forms, as its byproduct, a salt that has the property of absorbing moisture (a deliquescent salt) on it, serving as such an ink acceptor.

For instance, in Example 1 given herein later as one of the preferred embodiments of the present invention, Solution A (containing a salt formed from p-ethylphenol and sodium hydroxide) and Solution B (ammonium sulfate) applied to a cloth reacts to produce p-ethylphenol on the cloth with the formation of ammonia and sodium sulfate as byproducts of the reaction, the latter of which shows a moisture absorbing property, serving to prevent bleeding of the inks applied onto it or improve their penetration into it.

As mentioned above, it goes without saying that the objective of the present invention can be achieved by applying either Solution A or B contained in an ink acceptor onto a cloth before or after the application of the other solution to the cloth prior to its ink-jet printing.

The ink acceptors referred to above for use in an ink-jet printing system include natural pastes such as starch, natural rubber, natural gum and sodium alginate, semi-synthetic pastes such as hydroxyethylcellulose, carboxymethylcellulose, methylcellulose, hydroxymethylethylcellulose, processed starch and guar gum, and synthetic pastes such as polyvinyl acetate, polyoxyethylene, polyvinyl alcohol and polyacrylic acid.

Any of these ink acceptors can be used with one or more of publicly known pH controllers, surface active agents, level dyeing agents, carriers, dyeing accelerators, penetrants, catalysts, oil absorbents, antiseptics, holding agents, plasticizers, thermosetting resins, cross-linking agents, IR absorbers, UV absorbers, color fastness to light improvers, anti-oxidants, extender pigments, fluorescent whiteners, adsorbents, anti-reductants, sequestering agents, fillers, moisture absorbents, electrolytes, perfumes, antibacterial agents, deodorants, insecticides and other chemicals added to the ink acceptor in proper amounts as required.

The ink-jet systems that are useful in the present invention for application of Solutions A/B and dyes to a cloth include the charge modulating type, micro dotting type, electrification jet controlling type, ink mist type and other continuous type systems, and stemme (two-component) type, pulse jet (one-component) type, bubble jet type, electrostatic suction type and other on-demand type systems.

The cloth that is useful in the present invention includes any and all types of fabrics such as woven, knitted and non-woven. Among them, a pile fabric is preferable for use in the present invention because this fabric allows effective development of the resultant three-dimensional design patterns on the fabric.

The cloth that is useful in the present invention can comprise one or more of synthetic fibers of polyester, polyamide, polyacrylic and triacetate alone or combined with any other type of fiber.

The following describes exemplary embodiments of the present invention, which are intended to illustrate its basic principles and are not to be understood to limit its scope.

The cloth used to embody the present invention as shown in the following examples was prepared by subjecting a double raschel fabric composed of 180d polyester spun as its piles and 100d polyester filament as its ground yarn to a conventional process (consisting of brushing→shearing→heat setting) for raising before dyeing with a disperse dye (CI Disperse Blue 54) at a concentration of 1% o.w.f., followed by drying for finishing.

EXAMPLE 1

For treatment of the above-mentioned pile fabric with an ink acceptor, an ink acceptor solution was prepared according to the following recipe.

| Ink acceptor recipe | |
|---|---|
| Carboxymethylcellulose | 5 parts (by weight, which shall apply hereinafter) |
| Silicic acid | 1 part |
| Anti-reductant (Reactant MS made by Uni Chemical Co., Ltd.) | 1 part |
| Water | 93 parts |
| Total | 100 parts |

The ink acceptor solution thus prepared was applied to the pile fabric by mangle padding with an add-on of 15 g/m$^2$ in the dry state. The fabric was then subjected to hot-air drying before heat treatment at 140° C. for five minutes.

Then, Solution A was prepared according to the following recipe.

| Solution A recipe | |
|---|---|
| p-ethylphenol | 25 parts |
| Sodium hydroxide | 6.25 parts |
| Diethylene glycol | 1 part |
| Water | 67.75 parts |
| Total | 100 parts |

Viscosity: 3.8 cps

In preparing Solution A according to the above recipe, p-ethylphenol and diethylene glycol were mixed in water, to which sodium hydroxide was added before the mixture was thoroughly stirred for approximately 30 minutes for complete dissolution of p-ethylphenol.

The resultant solution was then filtered for removal of any insoluble impurities (such as foreign matter) in it to obtain Solution A.

Then, Solution B was prepared according to the following recipe.

| Solution B recipe | |
|---|---|
| Ammonium sulfate | 40 parts |
| Diethylene glycol | 1 part |
| Water | 59 parts |
| Total | 100 parts |

Viscosity: 3.0 cps

In preparing Solution B according to the above recipe, the two chemicals were mixed in water, and the mixture was thoroughly stirred for approximately 30 minutes to obtain a solution. The resultant solution was then filtered for removal of any insoluble impurities in it to obtain Solution B.

The fabric treated with the ink acceptor was set in an ink-jet printer, while Solutions A and B thus prepared were placed in the printer's two separate ink cartridges.

In addition, another ink cartridge of the printer in the same row as the above two ones was filled with a disperse dye ink prepared according to the following recipe for its simultaneous application to the fabric with the two solutions.

| Disperse dye ink recipe | |
|---|---|
| CI Disperse Red 127 | 5 parts |
| Anionic surface active agent | 4 parts |
| Antifoaming agent (Shin-Etsu Silicone KM-70 made by Shin-Etsu Chemical Co., Ltd.) | 0.05 part |
| Ethylene glycol | 3 parts |
| Silicic acid | 0.1 part |
| Ion exchanged water | 87.85 parts |
| Total | 100 parts |

Ink viscosity: 2 cps

Then, the ink-jet printer was run by computer-controlling its nozzle injection pressure, nozzle opening/closing, position, cartridge travel and other operating conditions according to the input design data to apply Solutions A, B and dye ink to the fabric in that order under the following ink-jet printing condition.

Ink-jet printing condition

Ink-jet printer: On-demand type serial scanning printer

Nozzle diameter: 50 $\mu$m

Driving voltage: 100V

Frequency: 5 KHz

Resolution: 360 dpi

4×4 matrix

The ink-jet printed fabric was then subjected to hot-air drying, followed by wet-heat treatment at 180° C. for 10 minutes. Subsequently, the fabric was immersed in a soaping solution, prepared according to the following recipe, with a liquor ratio of 100:1 at 80° C. for 30 minutes before being subjected to drying and pile trimming in sequence.

| Soaping solution recipe | |
|---|---|
| Sodium hydroxide | 1 part |
| Soaping agent (Lipotol TC-300 | 0.2 part |

-continued

| Soaping solution recipe | |
|---|---|
| made by Nicca Chemical Co., Ltd.) | |
| Warm water | 98.8 parts |
| Total | 100 parts |

The fabric thus obtained showed three-dimensional design patterns, sharp in their boundaries, on its pile surface with the fiber-shrinking agent and dye ink applied portion colored in red and depressed at a depth of 1.3 mm.

EXAMPLE 2

The same fabric as used in Example 1 was processed according to the same procedure as described in Example 1 for its ink-jet printing, except that the order in which Solutions A and B were applied to it was reversed.

EXAMPLE 3

Solution B containing an ink acceptor was prepared according to the following recipe.

| Solution B recipe | |
|---|---|
| Ammonium sulfate | 10 parts |
| Carboxymethylcellulose | 5 parts |
| Silicic acid | 1 part |
| Anti-reductant (Reactant MS made by Uni Chemical Co., Ltd.) | 1 part |
| Water | 83 parts |
| Total | 100 parts |

The Solution B thus prepared was applied to the same fabric as used in Example 1 by mangle padding with an add-on of 15 g/m$^2$ in dry state. The fabric was then subjected to hot-air drying before heat treatment at 140° C. for five minutes.

Then, Solution A was prepared according to the following recipe.

| Solution A recipe | |
|---|---|
| 2,4 dihydroxybenzaldehyde | 25 parts |
| Sodium hydroxide | 6.25 parts |
| Diethylene glycol | 1 part |
| Water | 67.75 parts |
| Total | 100 parts |

Viscosity: 3.0 cps

In preparing Solution A according to the above recipe, 2,4-dihydroxybenzaldehyde and diethylene glycol were mixed in water, to which sodium hydroxide was added before the mixture was thoroughly stirred for approximately 30 minutes for complete dissolution of 2,4-dihydroxybenzaldehyde.

The resultant solution was then filtered for removal of any insoluble impurities in it to obtain Solution A.

The fabric treated with the Solution B was set in the same ink-jet printer as used in Example 1, while Solution A and the same dye ink as used in Example 1 were placed in the printer's two separate ink cartridges.

The ink-jet printer was run to ink-jet print the fabric under the same condition as used in Example 1. The fabric was thereafter processed in the same way as in Example 1 to finish it.

EXAMPLE 4

Solution A containing a disperse dye was prepared according to the following recipe.

| Solution A recipe | |
|---|---|
| CI Disperse Red 127 | 5 parts |
| Anionic surface active agent | 1 part |
| Silicic acid | 0.1 part |
| p-t-butylphenol | 25 parts |
| Diethylene glycol | 1 part |
| Ion exchanged water | 61.65 parts |
| Total | 100 parts |

Viscosity: 4.3 cps

In preparing Solution A according to the above recipe, p-t-butylphenol, anionic surface active agent, silicic acid and diethylene glycol were mixed in water, to which sodium hydroxide was added before the mixture was thoroughly stirred for approximately 30 minutes for complete dissolution of p-t-butyl phenol.

To the resultant solution, the disperse dye was added. The mixture was then subjected to dispersion with a bead mill type dispenser for four hours to obtain a dye-dispersed solution.

The resultant dye-dispersed solution was then filtered for removal of any insoluble impurities in it to obtain Solution A.

Solution B was prepared according to the following recipe.

| Solution B recipe | |
|---|---|
| Ammonium tartrate | 30 parts |
| Diethylene glycol | 1 part |
| Water | 69 parts |
| Total | 100 parts |

Viscosity: 3.1 cps

In preparing Solution B according to the above recipe, the two chemicals were mixed in water, and the mixture was thoroughly stirred for approximately 30 minutes to obtain a solution. The resultant solution was then filtered for removal of any insoluble impurities in it to obtain Solution B.

Apart from the use of the Solution A containing the disperse ink and Solution B thus prepared, the same procedure as described in Example 1 was applied to the same fabric as used in Example 1 for its ink-jet printing. The ink-jet printed fabric was then processed under the same condition as used in Example 1 to finish it.

EXAMPLE 5

Solution A was prepared according to the following recipe.

| Solution A recipe | |
|---|---|
| 1-naphthol | 20 parts |
| Sodium hydroxide | 6.25 parts |
| Diethylene glycol | 1 part |

-continued

| Solution A recipe | |
|---|---|
| Ion exchanged water | 72.75 parts |
| Total | 100 parts |

Viscosity: 4.2 cps

In preparing Solution A according to the above recipe, 1-naphthol and diethylene glycol were mixed in water, to which sodium hydroxide was added before the mixture was thoroughly stirred for approximately 30 minutes for complete dissolution of 1-naphthol.

The resultant solution was then filtered for removal of any insoluble impurities in it to obtain Solution A.

Solution B containing a disperse dye was prepared according to the following recipe.

| Solution B recipe | |
|---|---|
| CI Disperse Red 127 | 5 parts |
| Anionic surface active agent | 1 part |
| Silicic acid | 0.1 part |
| Ammonium tartrate | 30 parts |
| Diethylene glycol | 1 part |
| Water | 62.9 parts |
| Total | 100 parts |

Viscosity: 3.2 cps

In preparing Solution B according to the above recipe, the dye and chemicals were mixed in water, and the mixture was subjected to dispersion with a bead mill type disperser for four hours to obtain a dye-dispersed solution.

The resultant dye-dispersed solution was then filtered for removal of any insoluble impurities in it to obtain Solution B.

Apart from the use of the Solution A and Solution B containing the disperse dye thus prepared, the same procedure as described in Example 1 was used to process the same fabric by applying the Solutions A and B to it in that order for its ink-jet printing. The ink-jet printed fabric was then processed under the same condition as used in Example 1 to finish it.

EXAMPLE 6

The same procedure as described in Example 1 was applied to the same fabric as used in Example 1, except that it was not treated with an ink acceptor before the application of Solutions A and B to it.

EXAMPLE 7

Solution A was prepared according to the following recipe.

| Solution A recipe | |
|---|---|
| CI Disperse Red 127 | 0.5 part |
| Ink acceptor (Mapro Gum NP made by Sanshosha) | 8 parts |

-continued

| Solution A recipe | |
|---|---|
| 2,4-dihydroxybenzaldehyde | 25 parts |
| Sodium hydroxide | 6.25 parts |
| Turpentine emulsion | 20–30 parts |
| Water | 40.25–30.25 parts |
| Total | 100 parts |

Viscosity: 6000 to 8000 cps

In preparing Solution A according to the above recipe, the chemicals were mixed in water, and the mixture was stirred for approximately one hour.

Solution B was prepared according to the following recipe.

| Solution B recipe | |
|---|---|
| Ink acceptor (Mapro Gum NP made by Sanshosha) | 4 parts |
| Ammonium tartrate | 30 parts |
| Silicic acid | 0.5 part |
| Water | 65.5 parts |
| Total | 100 parts |

Viscosity: 100 cps

In preparing Solution B according to the above recipe, the chemicals were mixed in water, and the mixture was stirred for approximately one hour.

Solution A was applied to the same fabric as used in Example 1 at a given position by screen printing. The fabric was dried under hot air and treated with Solution B by spraying.

The fabric was thereafter subjected to the same heat treatment and soaping as described in Example 1.

EXAMPLE 8

Solution B was prepared according to the following recipe.

| Solution B recipe | |
|---|---|
| Malic acid | 30 parts |
| Diethylene glycol | 1 part |
| Water | 69 parts |
| Total | 100 parts |

Viscosity: 2.9 cps

In preparing Solution B according to the above recipe, the chemicals were mixed in water, and the mixture was stirred for approximately 30 minutes to obtain a solution. The resultant solution was then filtered for removal of any insoluble impurities in it to obtain Solution B.

Apart from the use of the Solution B thus prepared, the same procedure as described in Example 1 was applied to the same fabric as used in Example 1 for its ink-jet printing. The ink-jet printed fabric was thereafter processed in the same manner as done in Example 1 to finish it.

EXAMPLE 9

Solution B was prepared according to the following recipe.

| Solution B recipe | |
|---|---|
| Sodium dihydrogen phosphate | 30 parts |
| Diethylene glycol | 1 part |
| Water | 69 parts |
| Total | 100 parts |

Viscosity: 3.1 cps

In preparing Solution B according to the above recipe, the chemicals were mixed in water, and the mixture was stirred for approximately 30 minutes to obtain a solution. The resultant solution was then filtered for removal of any insoluble impurities in it to obtain Solution B.

Apart from the use of the Solution B thus prepared, the same procedure as described in Example 1 was applied to the same fabric as used in Example 1 for its ink-jet printing. The ink-jet printed fabric was thereafter processed in the same manner as done in Example 1 to finish it.

Comparative Example 1

Solution C was prepared according to the following recipe.

| Solution C recipe | |
|---|---|
| p-t-butyl phenol | 10 parts |
| Dispersant (Demol C made by Kao Corporation) | 5 parts |
| Water | 85 parts |
| Total | 100 parts |

Viscosity: 2.8 cps

In preparing Solution C according to the above recipe, the chemicals were mixed in water, and the mixture was subjected to dispersion with a bead mill type disperser for six hours to obtain a p-t-butyl phenol dispersed solution.

Apart from the use of the Solution C thus prepared instead of Solutions A and B as used in Example 1, the same procedure as described in Example 1 was used to process the same fabric as used in Example 1 for its ink-jet printing, except that the Solution C was applied to it in an amount five times as large as that of Solution A applied to the same in Example 1.

Comparative Example 2

The chemicals as formulated in Example 7 for Solution A, apart from Demol C (dispersant) in 5 parts instead of sodium hydroxide, were mixed in water, and the mixture was subjected to dispersion with a bead mill type disperser for six hours before being adjusted for viscosity to obtain Solution D.

The solution D thus prepared was applied to the same fabric as used in Example 1 at a given position by screen printing. The fabric was dried under hot air and then processed in the same way as in Example 1 for wet-heat treatment and soaping, followed by drying and pile trimming.

Evaluation

The ink-jet printed fabrics obtained in Examples 1 to 9 and Comparative Examples 1 to 2 were subjected to the following evaluations, the results of which were shown in Table 2.

Table 1 summarizes the conditions under which the fabric was processed in Examples 1 to 9 and Comparative Examples 1 to 2.

1̂ Pattern Depth Ratio

The pattern depth ratio was determined by applying a given amount (200 $\mu l/mm^2$) of Solution A to a pile fabric to form a three-dimensional pattern on the fabric, and calculating the ratio of the depth of its depressed portion measured to its pile overall length.

2̂ Line Fineness

The line fineness was determined by applying Solutions A/B to a pile fabric to form a three-dimensional pattern on the fabric with a fine line, specifically 10 cm in length and 0.5 to 5 mm in width, as its rectangular depressed portion, and measuring the width of the minimum fine line that enables visual and tactual recognition of the three-dimensional pattern.

3̂ Pattern Outline Sharpness

The pattern outline sharpness was determined by applying Solutions A/B to a pile fabric to form a three-dimensional pattern on the fabric, and visually evaluating the sharpness of the outline of the pattern according to the following three-grade (○/Δ/×) rating scale.

○=Sharp outline of the pattern, giving a marked impression of being three-dimensional Δ=Slightly blunt outline of the pattern, but giving a satisfactory impression of being three-dimensional ×=Blunt outline of the pattern, giving little impression of being three-dimensional 4̂ Pattern Uniformity The pattern uniformity was determined by applying Solutions A/B to a pile fabric to form a three-dimensional pattern on the fabric, and visually evaluating the uniformity of its depressed portion according to the following four-grade (⊙/○/Δ/×) rating scale.

(Pattern Uniformity Rating Scale)

⊙=Highly uniform, giving a marked and fine impression of being three-dimensional ○=Fairly uniform, giving a good impression of being three-dimensional Δ=Slightly non-uniform, but giving a satisfactory impression of being three-dimensional ×=Non-uniform, giving no or little impression of being three-dimensional As can be seen clearly from Table 2, the pile fabrics processed according to the methods based on the present invention in Examples 1 to 9 have three-dimensional designed patterns formed on them, which feature not only the deepness of the resultant depressed portions, but also their sharpness and uniformity.

In addition, Table 2 shows that Solution A or B of the present invention can be applied to a cloth together with dyes contained in the solution without having any adverse effect on the dyes to form colored three-dimensional design patterns on the cloth.

As shown in Examples 1 to 5, the application of Solution A of the present invention to an ink acceptor treated cloth using an ink-jet printing system is particularly effective in forming a three-dimensional design pattern on the cloth with a higher degree of accuracy.

In contrast to the fabrics obtained in Examples 1 to 9, the ones in Comparative Examples 1 to 2, in which the present invention was not used, were found to have problems with dye bleed and pattern uniformity, and failed to give a satisfactory impression of being three-dimensional.

TABLE 1

| | | Example 1 | Example 2 | Example 3 | Example 4 | Example 5 | Example 6 |
|---|---|---|---|---|---|---|---|
| Solution A | Fiber-shrinking agent | p-ethyl phenol | p-ethyl phenol | 2,4-dihydroxy benzaldehyde | p-t-butyl phenol | 1-naphthol | p-ethyl phenol |
| | Neutralizer | Sodium hydroxide | Sodium hydroxide | Sodium hydroxide | Sodium hydroxide | Sodium hydroxide | Sodium hydroxide |
| Solution B | | Ammonium sulfate | Ammonium sulfate | Ammonium sulfate | Ammonium tartrate | Ammonium tartrate | Ammonium sulfate |
| | Solution A application method | Ink-jet | Ink-jet | Ink-jet | Ink-jet | Ink-jet | Ink-jet |
| | Pretreatment with ink acceptor | Provided | Provided | Provided | Provided | Provided | Not provided |
| | Solution A/B application order | A→B→dye | B→A→dye | B→A→dye | A (containing dye)→B | A→ B (containing dye) | A→B→dye |

| | | Example 7 | Example 8 | Example 9 | Comparative Example 1 | Comparative Example 2 |
|---|---|---|---|---|---|---|
| Solution A | Fiber-shrinking agent | 2,4-dihydroxy benzaldehyde | p-ethyl phenol | p-ethyl phenol | p-t-butyl phenol | 2,4-dihydroxy benzaldehyde |
| | Neutralizer | Sodium hydroxide | Sodium hydroxide | Sodium hydroxide | — | — |
| Solution B | | Ammonium tartrate | Malic acid | Sodium dihydrogen phosphate | — | — |
| | Solution A application method | Screen printing | Ink-jet | Ink-jet | Ink-jet | Screen printing |
| | Pretreatment with ink acceptor | Not provided | Provided | Provided | Provided | Not provided |
| | Solution A/B application order | A (containing dye)→B | A→B→dye | A→B→dye | — | — |

TABLE 2

| | Example 1 | Example 2 | Example 3 | Example 4 | Example 5 | Example 6 | Example 7 | Example 8 | Example 9 | Comparative Example 1 | Comparative Example 2 |
|---|---|---|---|---|---|---|---|---|---|---|---|
| Pattern depth ratio (%) | 22 | 22 | 20 | 21 | 20 | 14 | 18 | 21 | 21 | 14 | 10 |
| Line fineness (mm) | 0.8 | 0.8 | 0.7 | 1 | 1 | 2 | 2 | 0.8 | 0.9 | 3.8 | 4 |
| Pattern outline sharpness | ○ | ○ | ○ | ○ | ○ | Δ | ○ | ○ | ○ | X | ○ |
| Pattern uniformity | ◎ | ◎ | ◎ | ◎ | ◎ | ◎ | ○ | ◎ | ◎ | Δ | X |

As described above, the present invention, comprising a method for processing a cloth to form a three-dimensional design pattern on the cloth, consists of applying a water solution of a phenol derivative as a fiber-shrinking agent transformed into a water-soluble salt (Solution A) to the cloth and a water-solution of a certain agent to restore the water-soluble phenol derivative salt uniformly applied to the cloth as a precursor of the fiber-shrinking agent to its original phenol derivative (Solution B) to the cloth uniformly, and is therefore advantageous in forming an extremely uniform three-dimensional design pattern on the cloth.

In addition, the present invention has the advantage of allowing application of Solution A or B to a cloth together with dyes contained in the solution to enable the cloth to be subjected to simultaneous fiber shrinking and coloring, making it very conducive to the production of printed goods with highly accurate and uniform three-dimensional design patterns at reduced costs.

Furthermore, the present invention is advantageous in allowing the use of an ink-jet printing system for application of Solutions A, B and dyes to cloth with accurate control of the positions and amounts of their application on the cloth, enabling formation of further fine and sharp three-dimensional colored design patterns on it.

Moreover, the present invention, when implemented using an ink-jet printing system, allows Solutions A and B prepared in a low viscosity to be applied to a cloth, not only preventing the ink-jet printing system from undergoing nozzle clogging, but also forming a three-dimensional design pattern on the cloth with a sharp boundary of its depressed portion.

What is claimed is:

1. In a method of processing a cloth prior to the formation of a three-dimensional design pattern thereon, the improvement comprising the steps of:

treating the cloth with a solution A containing a salt formed from a phenol derivative and a hydroxide of an alkali or alkali earth metal; and treating the cloth with a solution B containing a chemical capable of restoring the salt in solution A to the original phenol derivative.

2. The method of claim 1, wherein the chemical capable of restoring the salt in solution A to the original phenol derivative is selected from the group consisting of a salt formed from an inorganic acid and a weak base, a carboxylic acid and a salt formed from a carboxylic acid and a weak base.

3. The method of claim 1, wherein the cloth is first treated with solution A and then treated with solution B prior to the application of a dye thereon.

4. The method of claim 1, wherein the cloth is first treated with solution B and then treated with solution A prior to the application of a dye thereon.

5. The method of claim 1, wherein the treatment of the cloth with solution A and solution B is performed with an ink-jet system.

6. The method of claim 3, wherein the dye is applied by an ink-jet system.

7. The method of claim 6, wherein solution A or solution B is contained in an ink acceptor solution.

8. The method of claim 1, wherein the salt in solution A is formed from p-ethylphenol and sodium hydroxide and the chemical in solution B capable of restoring the salt in solution A to p-ethylphenol is ammonium sulfate.

9. The method of claim 7, wherein the ink acceptor solution contains at least one member selected from the group consisting of starch, natural rubber, sodium alginate, hydroxyethylcellulose, carboxymethylcellulose, methylcellulose, hydroxymethylethylcellulose, processed starch, guar gum, polyvinyl acetate, polyoxyethylene, polyvinyl alcohol and polyacrylic acid.

10. The method of claim 1, wherein the phenol derivative is p-t-butylphenol and the chemical in solution B capable of restoring the salt in solution A to p-t-butylphenol is ammonium tartrate.

* * * * *